US006053449A

United States Patent [19]

Wolf et al.

[11] Patent Number: 6,053,449

[45] Date of Patent: Apr. 25, 2000

[54] YARN WINDING APPARATUS WITH SPINDLE SUPPORT

[75] Inventors: Klaus Wolf, Cologne; Jorg Spahlinger, Wermelskirchen; Uwe Baader, Wuppertal, all of Germany

[73] Assignee: Barmag AG, Remscheid, Germany

[21] Appl. No.: 09/232,337

[22] Filed: Jan. 15, 1999

[30] Foreign Application Priority Data

Jan. 17, 1998 [DE] Germany ..... 198 01 591
May 7, 1998 [DE] Germany ..... 198 20 374

[51] Int. Cl.[7] ..... B65H 18/08

[52] U.S. Cl. ..... 242/474.5; 242/474.8; 242/598

[58] Field of Search ..... 242/474.5, 474.6, 242/474.8, 596, 598

[56] References Cited

U.S. PATENT DOCUMENTS

| | | | |
|---|---|---|---|
| 2,082,031 | 6/1937 | Schultz et al. | 242/573.4 |
| 2,613,038 | 10/1952 | Heeley | 242/474.8 |
| 3,090,569 | 5/1963 | Beushausen | 242/445 |
| 3,607,566 | 9/1971 | Medney et al. | 242/439.4 X |
| 3,625,443 | 12/1971 | Knowles | 242/474.8 |
| 4,030,673 | 6/1977 | Veyrassat | 242/474.5 |
| 4,291,841 | 9/1981 | Dalrymple et al. | 242/474.5 |
| 4,304,364 | 12/1981 | Busch . | |
| 5,029,762 | 7/1991 | Behrens et al. . | |
| 5,234,173 | 8/1993 | Nishikawa et al. | 242/474.5 |
| 5,322,233 | 6/1994 | Hehner et al. | 242/596 |
| 5,354,010 | 10/1994 | Loos | 242/598 X |

FOREIGN PATENT DOCUMENTS

| | | |
|---|---|---|
| 0 374 536 | 3/1994 | European Pat. Off. . |
| 42 40 920 | 6/1993 | Germany . |
| 195 34 914 | 5/1996 | Germany . |

*Primary Examiner*—Donald P. Walsh
*Assistant Examiner*—Minh-Chau Pham
*Attorney, Agent, or Firm*—Alston & Bird LLP

[57] ABSTRACT

A yarn winding apparatus for winding each of a plurality of continuously advancing yarns to a package. The packages are wound on a winding spindle rotatably mounted in cantilever fashion on a movable spindle support. A stationary holding device is provided which is adapted for engaging the free end of the winding spindle without impeding the rotation of the winding spindle, so as to support the winding spindle at its free end with a holding force during the winding of the packages. Also, the winding spindle and the holding device can be joined to each other by two coupling elements without impeding the movement of the winding spindle which occurs during the winding operation to accommodate the build of the package.

26 Claims, 7 Drawing Sheets

YARN WINDING APPARATUS WITH SPINDLE SUPPORT

BACKGROUND OF THE INVENTION

The present invention relates to a yarn winding apparatus or takeup machine for winding a plurality of continuously advancing yarns into yarn packages.

Takeup machines of the described type are used in spinning lines for winding freshly spun multifilament yarns to packages. To this end, a plurality of bobbin tubes are inserted one after the other on a winding spindle mounted in cantilever fashion, and they are each uniformly wound with a yarn. In this process, as many as ten packages are wound side by side on the winding spindle at the same time, so that the winding spindle has a projecting length of more than one meter.

To realize high yarn speeds of more than 6,000 m/min., the winding spindle must operate, depending on the diameter of the packages, from the beginning to the end of the winding to a package (winding cycle) in a speed range from about 2,000 rpm to 30,000 rpm. In this connection, it is necessary to avoid in particular critical speeds which cause an undamped vibration of the winding spindle, so as not to destroy the unilateral mount of the winding spindle. A critical speed is present, when the frequency of excitation coincides with the inherent frequency of the winding spindle. Based on the wide speed range and the fact that the rotating masses constantly change during the winding cycle and thus influence the critical speeds, such critical speeds may occur. In addition, in particular at the end of a winding cycle, the winding spindle is subjected by the wound packages to a considerable dead weight, which causes the winding spindle to bend.

DE 195 34 914 discloses a takeup machine, wherein a holding device is mounted at the free end of the winding spindle. The holding device comprises a receptacle for engaging the free end of the winding spindle, so that the winding spindle receives a supporting mount at its free end. This holding device is made pivotal, so as to enable a movement of a spindle support that guides the winding spindle. To this end, the spindle support and the holding device are driven. For doffing the packages a gripping device is provided, which disengages the winding spindles from the holding device and removes same from the spindle support. This takeup machine requires a considerable mechanical complexity that is difficult to manage. Furthermore, the drive of the holding device and the drive of the spindle support must be totally synchronous, so that there is no delay on the winding spindle.

A very similar takeup apparatus is disclosed in U.S. Pat. No. 5,234,173. In this apparatus, the gripping device that disengages the winding spindle for doffing the package may be omitted, since the holding device is constructed for such a swinging movement that the winding spindle is released for doffing the full packages. However, the known takeup apparatus has the disadvantage that for purposes of performing a rotation and a swinging movement, the holding device requires a very complex construction, which exhibits in particular an inadequate stability for absorbing vibrations of the winding spindle.

U.S. Pat. No. 4,304,364 discloses a further takeup machine, wherein during the winding cycle a holding device is mounted at the free end of the winding spindle. This holding device has a cone that cooperates in formfitting manner at the free end of the winding spindle with a cone in the winding spindle. The holding device is constructed for swinging movement, so as to be able to doff packages on the winding spindle. In this takeup machine, the winding spindle is stationarily mounted in the machine frame, so that a movement of the holding device is necessary only for purposes of stripping the winding spindles. However, even in this case, it is necessary to align the winding spindles in their unloaded state and the holding device very exactly, so as to enable an engagement without delaying the winding spindle.

DE 42 40 920 discloses a takeup machine, wherein two winding spindles are arranged on a rotatable spindle support and alternately rotated to a winding range and a doffing range by rotating the spindle support. For damping the vibration, a vibration absorber is arranged in the frame of the takeup machine. Such vibration absorbers show an optimal damping behavior only in a relatively narrowed frequency range. With that, however, it is not possible to damp the vibrations in the takeup machine over the entire speed range. On the contrary, the ranges of the critical speeds are shifted only in terms of frequency. In the extreme case, traversing the critical speeds may lead to a breakdown of the takeup machine.

It is therefore an object of the invention to further develop a yarn winding or takeup machine of the initially described type, so that the winding spindle can be engaged in a simple manner with a holding device which facilitates, irrespective of the movement of the spindle support, winding of a plurality of yarns in the entire operational speed range with a large distribution of the rotational speed.

A further object of the invention is to provide a yarn winding or takeup machine which can be used in particular in the low speed range with a high dead weight of the winding spindle with a winding spindle longer than one meter.

SUMMARY OF THE INVENTION

The above and other objects and advantages of the present invention are achieved by the provision of a yarn winding apparatus which comprises a spindle support rotatably mounting at least one winding spindle in cantilever fashion so that the winding spindle defines a free end, with the spindle support being mounted to a machine frame for movement such that the winding spindle may be moved between a winding position and a package doffing position and such that the spindle support and the winding spindle can move relative to the machine frame while the winding spindle is at the winding position to accommodate the build of a package. A spindle holding device is provided for supporting the free end of the winding spindle while it is positioned in the winding position, and the spindle holding device comprises a first coupling element fixed to the machine frame and a second coupling element mounted at the free end of the winding spindle. The first and second coupling elements are configured for interengagement when the winding spindle is in the winding position and for disengagement when the winding spindle is in the doffing position, and the interengagement is maintained during relative movement of the first and second coupling elements caused by the movement of the winding spindle while the winding spindle is at the winding position.

A drive is provided for selectively moving the spindle support and thus the winding spindle while the winding spindle is at the winding position to accommodate the build of a package and to move the winding spindle between the winding position and the doffing position.

A feature of the present invention is the fact that the winding spindle is supported during the winding cycle without impeding the movement of the spindle support. To this end, the holding device comprises two coupling elements, with one of the coupling elements being fixedly mounted on the frame of the takeup machine, and the other coupling element being connected to the winding spindle. To engage the winding spindle, the two coupling elements cooperate.

By moving the spindle support, it is possible to engage and disengage the coupling elements. Thus after completion of a winding cycle, it is possible to move the spindle support and thereby move the winding spindle to a doffing range for replacing the full packages with empty tubes, thereby separating from each other the coupling elements of the holding device which are movable relative to each other. The coupling element on the winding spindle is designed and constructed such that it permits an unhindered doffing of the packages. After the full packages are replaced with empty tubes, the spindle support returns the winding spindle to the winding range. In so doing, the two coupling elements engage, so that a support of the winding spindle becomes effective at the free end thereof.

In a particularly advantageous further development of the invention, the coupling elements are interconnected by a magnetic force. This further development is characterized in that without a centering between the winding spindle and the holding device, it is possible to generate a holding force that is effective in the entire speed range of the winding spindle. Since the engagement between the winding spindle and the holding device is independent of the relative position of the winding spindle and the holding device, it is also possible to activate the engagement only during a time period of the winding cycle. With that, it would be possible to operate the winding spindle in the uncritical range with a disengaged holding device. Only after the packages lead to a considerable dead weight of the winding spindle, can the holding device be engaged with the winding spindle.

Besides relieving the winding spindle, the magnetic holding force results in a stabilization at the free end of the winding spindle and, thus, in a considerable damping of vibrations. In particular, it is possible to reduce out-of-balance vibrations. Thus, the takeup machine of the present invention is especially suitable for winding packages with a large diameter. In this instance, the winding spindle may operate in a speed range below 2,500 rpm.

The coupling elements may take the form of a magnet fixedly connected to the machine frame, and a magnetizable end plate which is mounted for rotation at the free end of the winding spindle. This is especially suited for applying high supporting or bearing forces to the free end of the winding spindle. In particular, in the case of very long winding spindles, it is possible to reduce bending stress and, thus, flexure, of the winding spindle to a considerable extent.

The magnet may be mounted to a holding device of the frame by means of an elastic damping element, which is advantageous to damp vibrations of the winding spindle. To this end, the magnet used for engagement is elastically mounted to the holding device by means of damping elements. Such damping elements may be, for example, rubber buffers.

To ensure enlargement or build of the package during the winding cycle, the winding spindle is moved by means of the movable spindle support. According to the one embodiment of the invention, the magnet is a permanent magnet which generates a holding force which is less than the driving torque generated by the drive which moves the spindle support. Thus, the winding spindle may remain engaged with the holding device during a movement of the winding spindle. This prevents unsteady vibration phenomena on the winding spindle, and leads to a uniform winding of the package.

The magnet may alternatively be an electromagnet, which has a controllable magnetic field strength. This provides the advantage that it is possible to generate greater holding forces on the winding spindle, in particular, when the spindle support is at a standstill, whereas smaller holding forces may be applied during the movement of the spindle support. This embodiment is therefore especially suited with the use of stepwise driven spindle supports. However, with the use of an electromagnet, it is also possible to generate on the winding spindle a variable holding force during the winding cycle. Thus, it is possible to generate a correspondingly great holding force in the critical speed ranges. It is likewise possible to release the engagement between the winding spindle and the holding device entirely in uncritical speed ranges. For example, as a result thereof, it is possible to minimize frictional losses at the beginning of the winding cycle at the highest speeds of the winding spindle.

In an especially preferred embodiment of the takeup machine, the winding spindle can be engaged in a simple manner with the holding device in any position of the spindle support. To this end, the free front end of the winding spindle mounts a magnetizable end plate, which connects to a plunger arranged for rotation in the winding spindle. The end plate is constructed for axial movement with the plunger relative to the winding spindle, so as to permit axial movement of the end plate by magnetic forces from an idle position to an operating position. The operating position is defined by contact on a contact surface of the magnet. To enable a deflection of the winding spindle in its engaged state as the package diameter increases, the contact surface and the end plate are aligned transverse to the axis of the winding spindle, so that the end plate can slide along the contact surface. To keep the sliding resistance as low a possible, the contact surface could be provided with a coating.

In a further advantageous embodiment of the takeup machine, an engagement between the winding spindle and the holding device may occur over the entire range or a partial range of the winding cycle. To this end, a magnetizable contact plate forms the contact surface. The magnet is arranged on the contact plate on the side opposite to the contact surface.

To exert great holding forces on the winding spindle, or to cover a large range of movement of the winding spindle, a further development of the takeup machine involves using a plurality of magnets arranged side by side and in a common plane on the back side of the contact plate.

The magnetizable end plate may be connected to the winding spindle via elastic bearing elements. Thus the end plate can perform small movements relative to the winding spindle, so as to compensate, for example, for tolerances in its contact with the contact surface of the contact plate.

In a further development of the invention, the coupling elements are constructed such that they form a formfitting engagement between the winding spindle and the holding device. As a result, the winding spindle is supported during the winding operation substantially free of vibrations and without undue deflections. The movement of the spindle support can be performed without moving the holding device, which is stationarily mounted on the frame of the takeup machine.

According to this further development, the coupling elements are constructed as a groove and a mandrel extending into the groove. To this end, the takeup machine of the present invention is provided at the free end of the winding spindle with a mandrel that engages in formfitting manner a groove of the holding device. The groove of the holding device has a direction which is congruent with the guide path of the winding spindle that is moved by the spindle support, so that the mandrel of the winding spindle slides in the groove during the movement of the spindle support which occurs during the winding cycle.

Since essential stresses on the winding spindle occur only while the package is being wound (winding cycle), a further development of the takeup machine according to the invention is especially advantageous, wherein the groove extends over only a partial range of the guide path of the winding spindle, through which the winding spindle travels, for example, under high loads. To enable the engagement of the winding spindle with the holding device, the holding device is provided at the groove ends with an inlet and an outlet for receiving the mandrel of the winding spindle. This configuration of the takeup machine in accordance with the invention permits engagement of the winding spindle with the holding device in a simple manner by moving the spindle support. To this end, the groove with the inlet and outlet ends may be arranged in the plane of movement of the mandrel. However, for purposes of engaging it is also possible to move the mandrel to a position, which permits engagement with the holding device.

In this embodiment, it is possible to doff the packages with no obstruction. To this end, the spindle support moves the package to a doffing range. In so doing, the mandrel slides out of the groove through the outlet end of the holding device. Thus, the end of the winding spindle is freely accessible for doffing the packages.

A particularly advantageous further development of the takeup machine in accordance with the invention, may be used preferably in a takeup machine, wherein the winding spindle is held in a stationary position during the winding cycle. The position of the winding spindle is predetermined by an indentation in the holding device.

The groove may alternatively have a uniform cross-section between the inlet and outlet ends of the groove, along the path covered by the winding spindle during the winding cycle. This facilitates the changing by means of the driven spindle support of the center distance between the contact roll and the winding spindle in the sense of an increasing package diameter.

To keep the relative movement between the mandrel and the holding device as small as possible, a further development provides that the mandrel has an end which is rotatably supported in the free end of the winding spindle. To be able to transmit and receive adequate holding forces between the mandrel and the holding device, the mandrel has an extension, which extends into the groove of the holding device.

However, it is also possible to connect the mandrel unmovably to the winding spindle. In this instance, there would be a support between the extension and the mandrel. Thus, the extension would be placed on the mandrel in annular form.

The mandrel may be connected to the winding spindle via elastic bearing elements. This provides the advantage that the mandrel can perform slight movements relative to the winding spindle, so as to compensate, for example, for tolerances in the guidance in the groove of the holding device.

For damping vibrations of the winding spindle, an elastic slide means is preferably inserted between the extension of the mandrel and the groove of the holding device. A further advantage lies in that there is no substantial wear between the sliding pair of mandrel and groove.

In an especially advantageous further development of the invention, the mandrel is made axially movable relative to the winding spindle against a spring. This ensures that an axial relationship is maintained during the engagement between the groove of the holding device and the mandrel of the winding spindle during the entire time of engagement.

To obtain a continuous course of the process when winding the yarns, the takeup machine is equipped with two winding spindles, which are arranged in offset relationship on the spindle support. The spindle support is connected to a rotational drive. Once the packages of the first winding spindle have reached their desired size, the engagement between the winding spindle and the holding device is released. By rotating the spindle support, the second winding spindle with empty tubes is rotated into the winding range. At the same time, the first winding spindle arrives at a doffing range, in which the full packages can be removed. During the winding, the second winding spindle engages the holding device at its free end side, for example, by activating an electromagnet.

When a takeup machine is used with two winding spindles, both winding spindles are constructed with a mandrel which is received in a groove as described above. In this instance, the mandrel of the first winding spindle slides through the outlet end out of the groove of the holding device. By rotating the spindle support, the second winding spindle with the empty tubes is rotated into the winding range. In this process, the mandrel of the second winding spindle automatically enters through the inlet end into the groove of the holding device. At the same time, the first winding spindle arrives at a doffing range, in which the full packages can be removed. During the winding, the second winding spindle is engaged on its free end side with the holding device.

The method of the present invention is characterized in that engagement of the winding spindle occurs only in the critical phases of the winding cycle. The methods known from the prior art have the disadvantage that the drive of the winding spindle must be designed such that during the entire winding cycle, the winding spindle is driven against the friction of two bearing points. In the method of the present invention, the frictional engagement of the winding spindle can be released during the winding cycle. To this end, the holding force at the free end of the winding spindle is changed to the value zero. Only upon reaching, for example, the lower speed range, in which the packages mounted on the winding spindle result in a relatively high dead weight of the winding spindle, can the holding force be adjusted to a maximal value.

In a particularly preferred variant of the method, the holding force is generated by an electromagnet with controllable field strength. Thus, it is possible that both winding of the yarn and engaging the winding spindle can be performed by means of an electric control unit.

In a takeup machine of the type described herein, the winding spindle may be periodically moved during the winding cycle by the periodic movement of the spindle support, in the sense of increasing the center distance between a contact roll and the winding spindle to accommodate the build of the package. When a controllable electromagnet is employed as described above, the holding force may be adjusted during the movement of the spindle support, so as to provide no substantial resistance to the movement of the spindle support when the winding spindle is moving. Only when the spindle support is stopped, is the holding force increased for supporting the winding spindle.

BRIEF DESCRIPTION OF THE DRAWINGS

The takeup machine of the present invention as well as its advantages are described in more detail with reference to the attached drawings, in which.

DETAILED DESCRIPTION OF THE PREFERRED EMBODIMENTS

Figure 1:
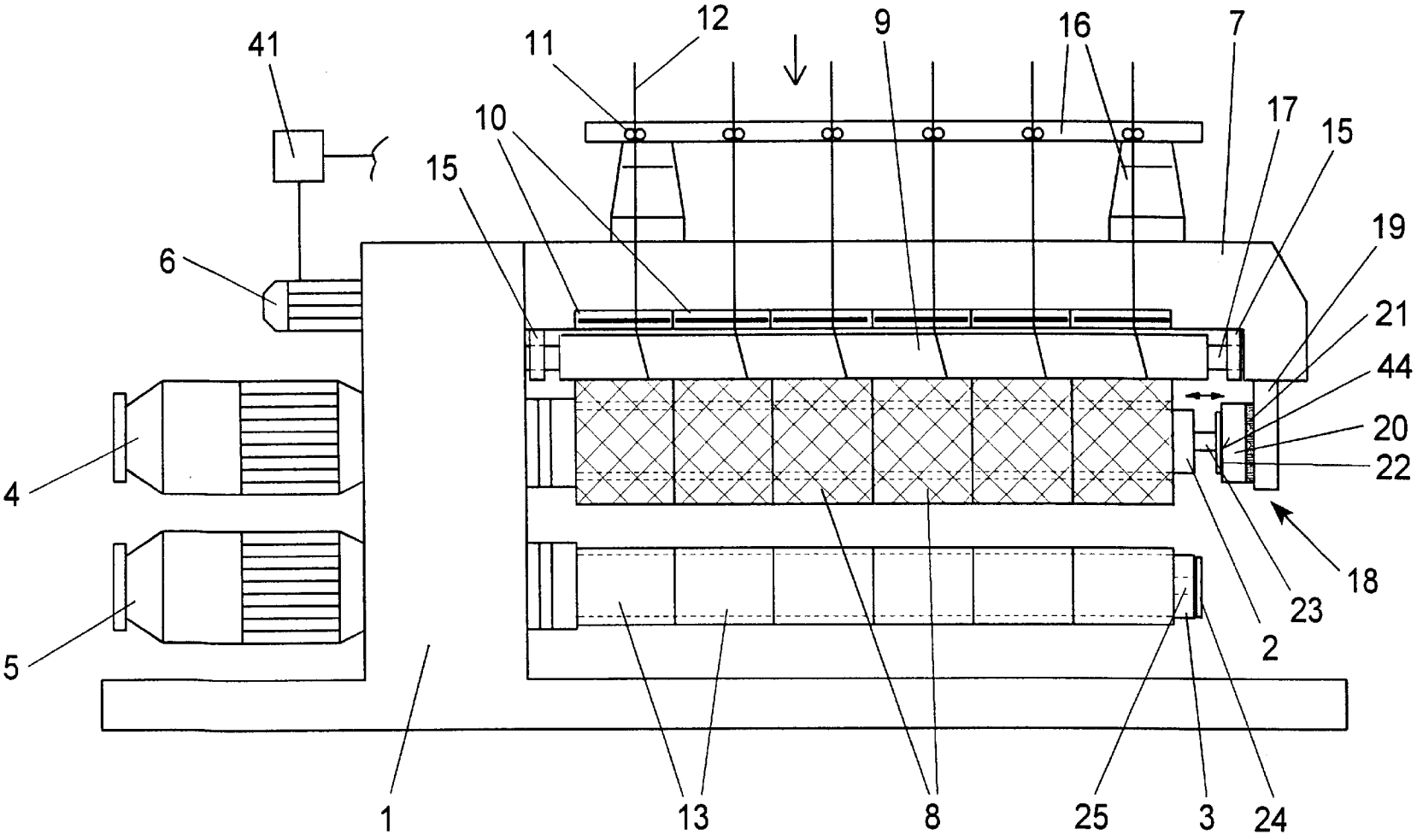
FIG. 1 is a schematic front view of a first embodiment of a takeup machine of the present invention.
Figure 2:
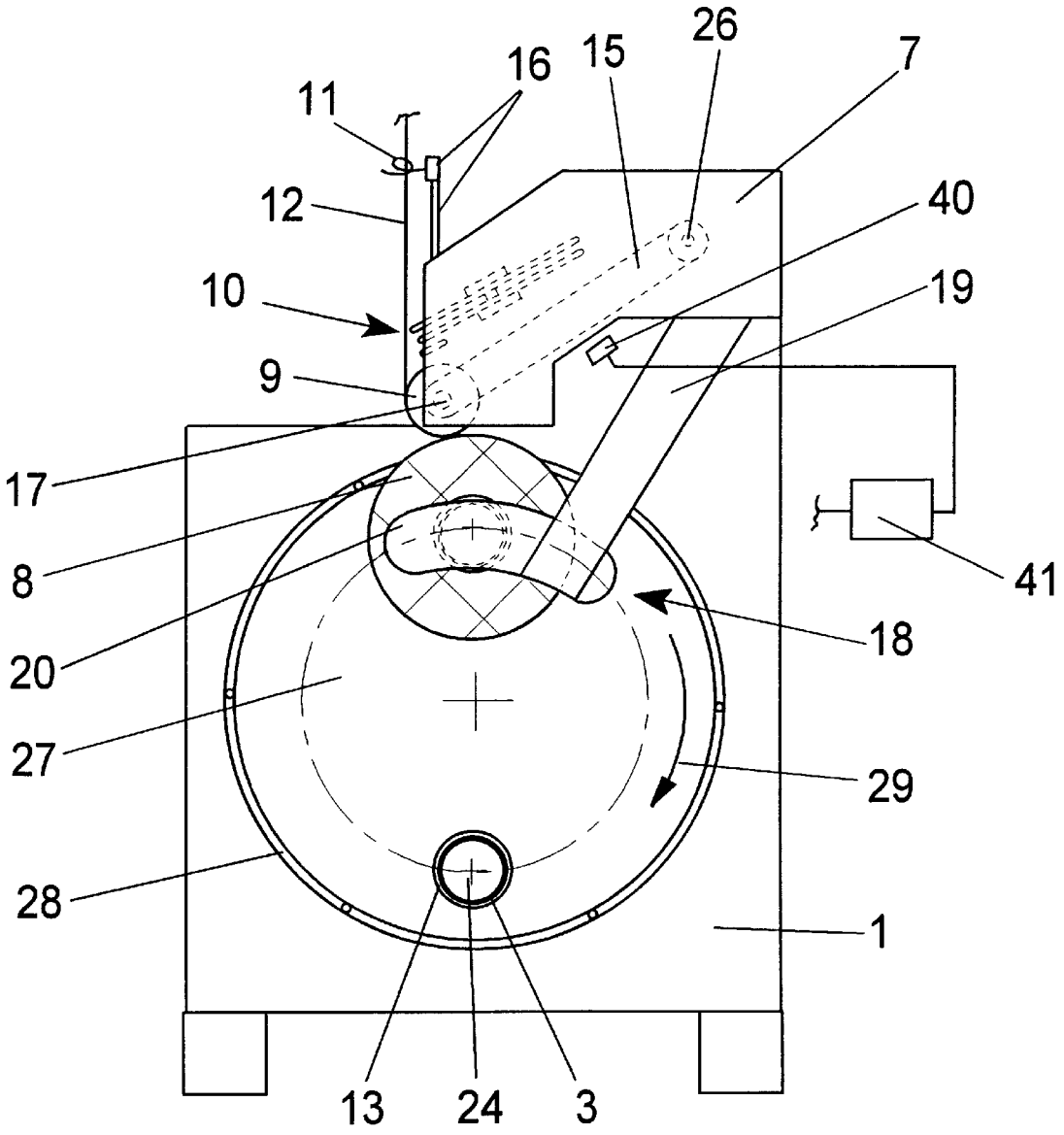
FIG. 2 is a schematic side view of the takeup machine of FIG. 1.

A first embodiment of the takeup machine in accordance with the invention is schematically shown in FIGS. 1 and 2. Unless otherwise specified, the following description will apply to both Figures.

The takeup machine comprises a frame 1. In the machine frame 1, a rotatable spindle support 27 is mounted for rotation in a bearing 28 (FIG. 2). The spindle support 27 is connected to a rotational drive 6 and can be moved by same for rotating in direction of arrow 29. The spindle support 27 mounts for rotation two winding spindles 2 and 3 in cantilever fashion. The winding spindle 2 is driven by a spindle motor 4 which is arranged on the spindle support 27 in the axial extension of the winding spindle 2. The winding spindle 3 connects to a spindle motor 5 which is likewise arranged on the spindle support 27 in the axial extension of winding spindle 3. Packages 8 are wound on the winding spindle 2. A total of six packages are simultaneously wound on the winding spindle 2. The number of the winding positions is by way of example. The takeup machine may have as many as ten winding positions. In each winding position, a yarn 12 advances via a yarn guide 11 to a yarn traversing device 10. To this end, the yarn guide 11 is mounted on a holder 16. The holder 16 is supported on a beam 7 that is stationarily connected to the machine frame 1. The beam 7 mounts yarn traversing devices 10 in side-by-side relationship. In the yarn path below the traversing devices 10, a contact roll 9 is arranged. The contact roll 9 is supported with its axle 17 in a rocker arm 15. The rocker arm 15 connects via a swivel bearing 26 to beam 7. The contact roll 9 rests against the surface of packages 8 under a certain contact pressure. During the winding, the spindle motor 4 is controlled such that the circumferential speed of the packages 8 remains constant. To this end, the circumferential speed of the contact roll 9 is constantly measured for controlling purposes.

A holding device 18 is arranged in spaced relationship at the free end of the winding spindle 2 opposite to the end side thereof. The holding device 18 comprises a support 19 that is stationarily connected to beam 7. The support 19 elastically mounts as a first coupling element a magnet 20. To this end, an elastic damping element 21 is arranged between the support 19 and the magnet 20. The magnet 20 is, for example, a permanent magnet. An end plate 22 lies as a second coupling element against a contact surface 44 of the magnet 20. The second coupling element is arranged on the free end of the winding spindle 2. To this end, the end plate 22 is fixedly connected to a plunger 23. The plunger 23 is mounted for rotation in a coaxial bore in the free end of the winding spindle 2. The end plate 22 can thus perform with plunger 23 an axial movement relative to the winding spindle 2. As shown in FIG. 1, the end plate 22 of winding spindle 2 is axially extended and in an operating position. In this operating position, the end plate 22 is frictionally engaged by a magnetic force with the magnet 20 of the holding device 18.

The free end of winding spindle 3 mounts likewise an end plate 24. The end plate 24 connects to a rotatably supported plunger 25. In the Figure, the end plate 24 is in an idle position, in which it lies against the end side of winding spindle 3.

A yarn 12 continuously advances to the takeup machine. In so doing, the yarn advances through the yarn guide 11 and reaches the traversing device 10. The traversing device is of the rotary blade type, wherein two rotary blades are driven in opposite directions for rotation in two adjacent planes. Within a traverse stroke, the rotary blades alternately reciprocate the yarn 12. At each traverse stroke end, the yarn is transferred from the one rotary blade of one plane to the other rotary blade of the adjacent plane. The yarn partially loops about the contact roll 9 and is deposited on the package 8. To this end, the winding spindle 2 is driven in clockwise direction.

The principle of controlling the winding operation is already known from EP 0 374 536, and corresponding U.S. Pat. No. 5,029,762, which are hereby incorporated by reference. In this known process, the spindle support 27 is rotated in the winding range during the winding operation by rotational drive 6 which is controlled via the deflection of contact roll 9, in accordance with the diameter of package 8 as same increases during the winding cycle. To this end, the position of contact roll 9 is detected by means of a sensor 40, and a corresponding signal is supplied to a controller 41 in the event of a deviation from the desired position. When the package becomes full, the spindle support motor 4 operates to move the rotating spindle 2 with the full packages to the doffing position, while the winding spindle 3 with empty bobbin tubes moves to the winding position. Also, the advancing yarn is automatically transferred from the rotating full packages to a rotating empty bobbin tube on the then rotating spindle 3, in a manner more fully described in the above-referenced patents.

As shown in FIG. 2, the magnet 20 is shaped such that during the entire winding cycle the end plate 22 of winding spindle 2 remains engaged with the magnet 20. When the spindle support 27 is rotated, the end plate 22 will slide along contact surface 44 of permanent magnet 20. The torque from the rotational drive 6 that is operative upon the winding spindle 2 overcomes in this instance the magnetic holding forces. In this embodiment, the holding force that supports the free end of winding spindle 2 thus remains constant during the entire winding cycle.

However, the magnet 20 could also be shaped such that the winding spindle 2 is engaged with the holding device 18 only in a partial range of the winding cycle. As soon as the winding spindle reaches with its end plate the radius of action of the magnet 20 as a result of the rotation of spindle support 27, magnetic forces will bring the end plate from its idle position to its contacting position. Thus, the winding spindle is automatically engageable without additional auxiliary means. Likewise, a disengagement of the end plate 22 from magnet 20 occurs in that upon leaving the radius of action of the magnet 20, the end plate 22 automatically returns to its idle position, for example, by a spring force. In this connection, the end plate may be constructed as shown FIG. 3.

Figure 4:
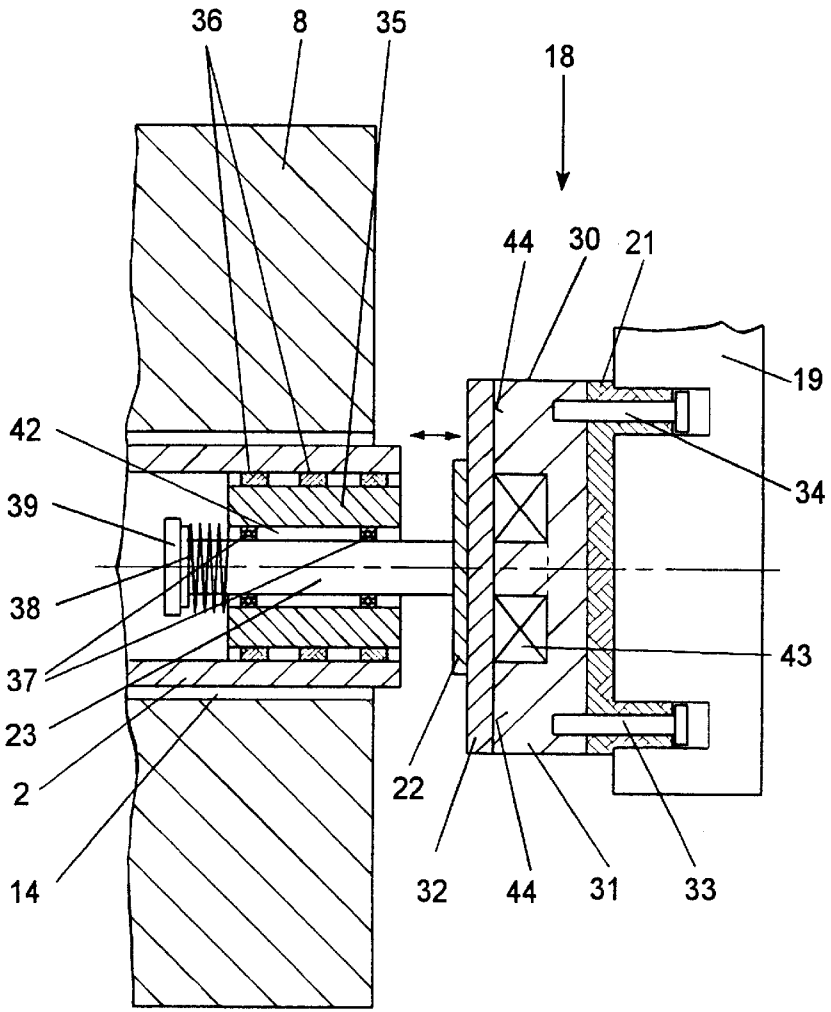
FIGS. 3 and 4 are each a cross sectional view of an embodiment of a holding device in engagement with the winding spindle.
Figure 3:
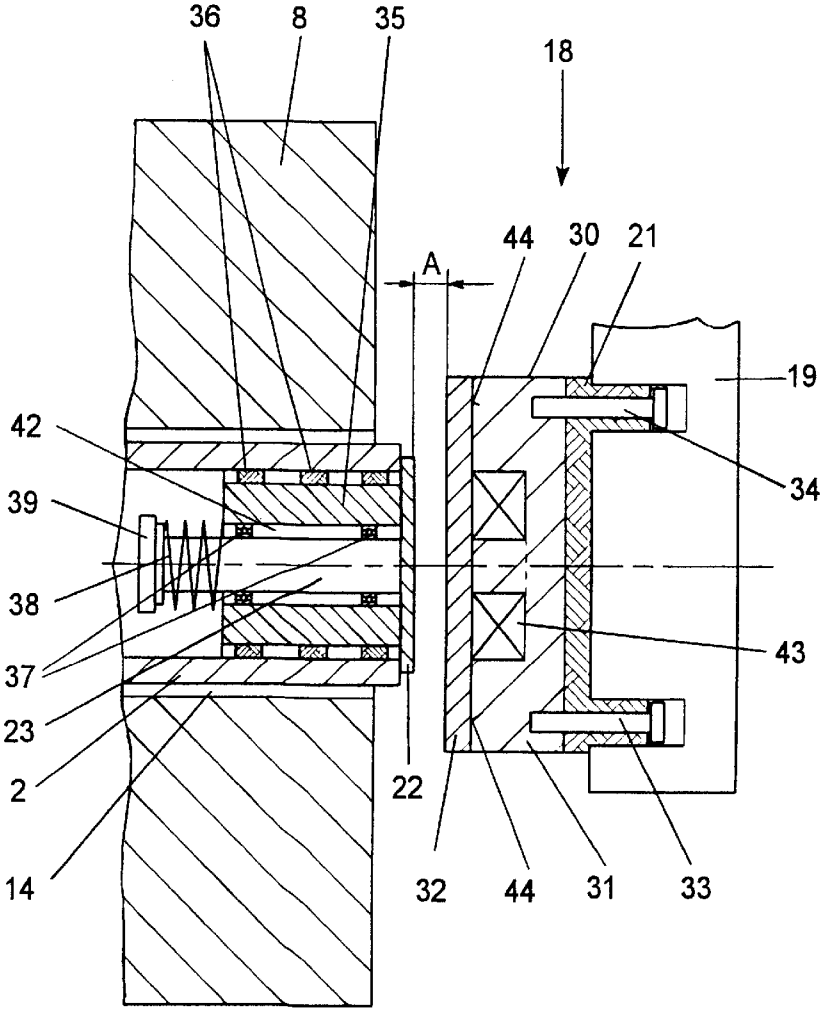

FIGS. 3 and 4 each show a cross-sectional view of a further embodiment of a holding device, as could be used in a takeup machine of FIG. 1. These Figures illustrate a cross sectional view of the free end of winding spindle 2. Mounted on the circumference of winding spindle 2 are winding tubes 14. On the winding tubes 14 packages 8 are wound. To this end, the winding spindle 2 is rotated. The free end of the winding spindle 2 is made hollow cylindrical. At the end, in the casing of winding spindle 2, a sleeve 35 is fixedly connected via a plurality of elastic bearing elements 36 to the casing of the winding spindle 2. In its center, the sleeve 35 has a bearing bore 42. In the bearing bore 42, a plunger 23 extends for rotation in bearings 37. One end of the plunger 23 projects from the end side of the winding spindle. At this end, an end plate 22 is connected to the plunger 23. At the opposite side, the plunger 23 is provided with a cap 39. Likewise this end of the plunger 23 that extends in the interior of the winding spindle is located outside of sleeve 35. Between cap 39 and sleeve 35, a compression spring 38 is arranged in concentric relationship with the plunger 23. Thus, the compression spring 38 exerts on the plunger 23 a spring force that is directed in the axial direction toward the bearing end of winding spindle 2.

Shown in FIG. 3 is a situation, in which the end plate 22 remains with plunger 23 in an idle position. In this position, the end plate 22 lies against the free end of winding spindle 2. The end plate 22 is spaced from the holding device 18 by a distance A. The holding device of this embodiment comprises a support 19 that is mounted to the machine frame as shown in FIG. 2. The support 19 mounts an electromagnet 30. The electromagnet comprises an electric coil 43, which is embedded in a casing 31. The casing 31 is connected to the support 19 via pins 33 and 34. Between the casing 31 and the support 19 an elastic damping element 21 is arranged. The elastic damping element 21 is made preferably from an elastomeric material. The contact surface 44 formed by the casing 31 faces the free end of winding spindle 2. In this embodiment, the contact surface 44 constitutes at the same time the pole surface of electromagnet 30. A contact plate 32 overlies the contact surface 44. Preferably, the contact plate 32 is made of a ferromagnetic material, so that is can be magnetized by the electromagnet 30.

FIG. 3 shows the situation, in which the electromagnet 30 is not activated. The end plate 22 lies against the free end of winding spindle 2.

FIG. 4 illustrates the situation, in which the electromagnet 30 is activated. As a result, the end plate 22 is moved by magnetic forces from its idle position to an operation position. The end plate 22 lies with its entire surface against contact plate 32. It is thereby possible to transmit very great holding forces from the holding device 18 to the free end of winding spindle 2.

As a result of the elastic mount of the electromagnet, it is possible to compensate alignment error between the surfaces of contact plate 32 and end plate 22. In addition, the end plate 22 with plunger 23 is elastically mounted relative to the casing of winding spindle 2. The embodiment of the takeup machine in accordance with the invention as shown in FIG. 3 and 4, is therefor especially suited for damping vibrations that occur on winding spindle 2.

This arrangement has also the advantage that the holding force generated by the electromagnet 30 is variable. Thus, it is possible to compensate for a weight change that occurs on the winding spindle during the winding cycle. In addition, there exists the possibility of controlling the electromagnet while the rotational drive of the spindle support is being activated, in such a manner that a lesser holding force is generated. To this end, the electromagnet is controlled by means of controller 41. The torque to be applied by the rotational drive can be kept at a low level despite the engaged spindle.

In the embodiment of the takeup machine of FIGS. 3 and 4, it is also possible to mount the support 19 with a swivel bearing to the frame of the takeup machine. In this arrangement, the holding device 18 is moved by the rotation of spindle support 27. Such an arrangement has the advantage that the contact plate 32 must be only insignificantly larger than the end plate 22. In this instance, it would be possible to rotate the holding device 18 from an idle position by engagement with the winding spindle 2. As soon as the electromagnet 30 is deactivated, the holding device 18 would return to its idle position, so as to be on standby for engagement with the second winding spindle.

Figure 5:
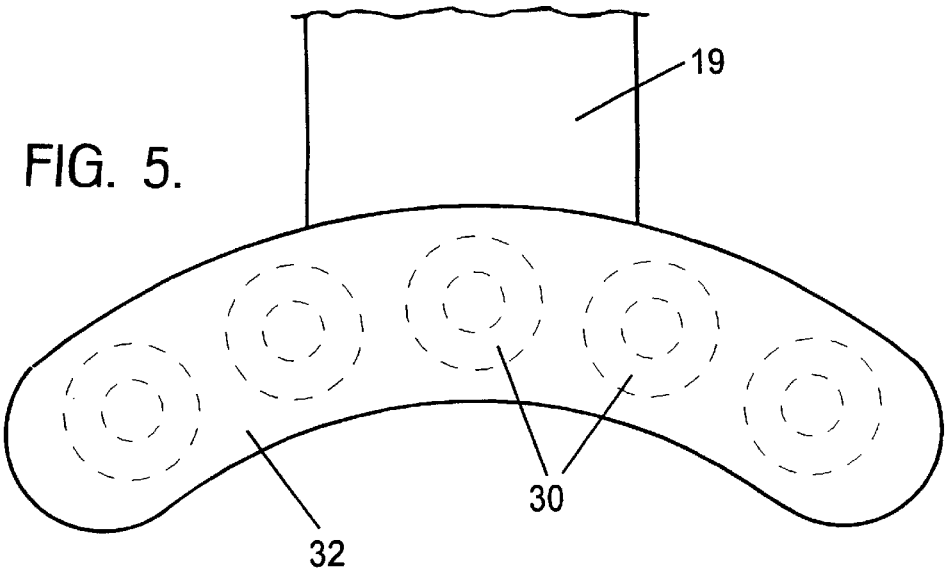
FIG. 5 is a schematic view of a further embodiment of a holding device.

FIG. 5 shows a further embodiment of a holding device. This Figure shows a front view of the holding device. The holding device comprises a support 19. On the support 19, a plurality of electromagnets 30 are embedded side by side in a casing. The contact plate 32 lies against the pole surface of the electromagnet. This embodiment is especially suited for applying very great holding forces. The contact plate 32 is shaped such that the end plate lies against contact plate 32 during at least one stage of the winding cycle.

Figure 7:
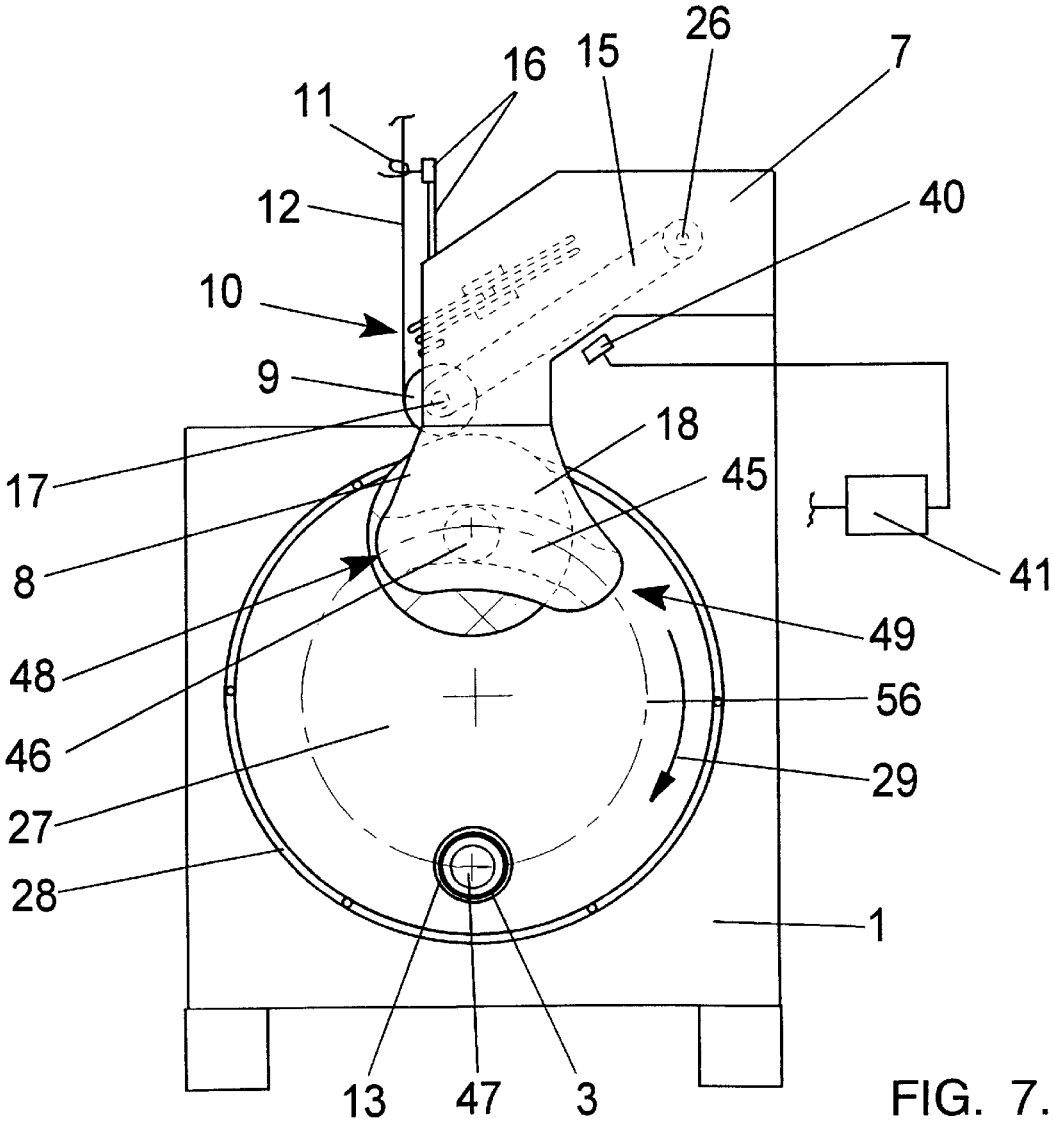
FIG. 7 is a schematic side view of the takeup machine of FIG. 6.
Figure 6:
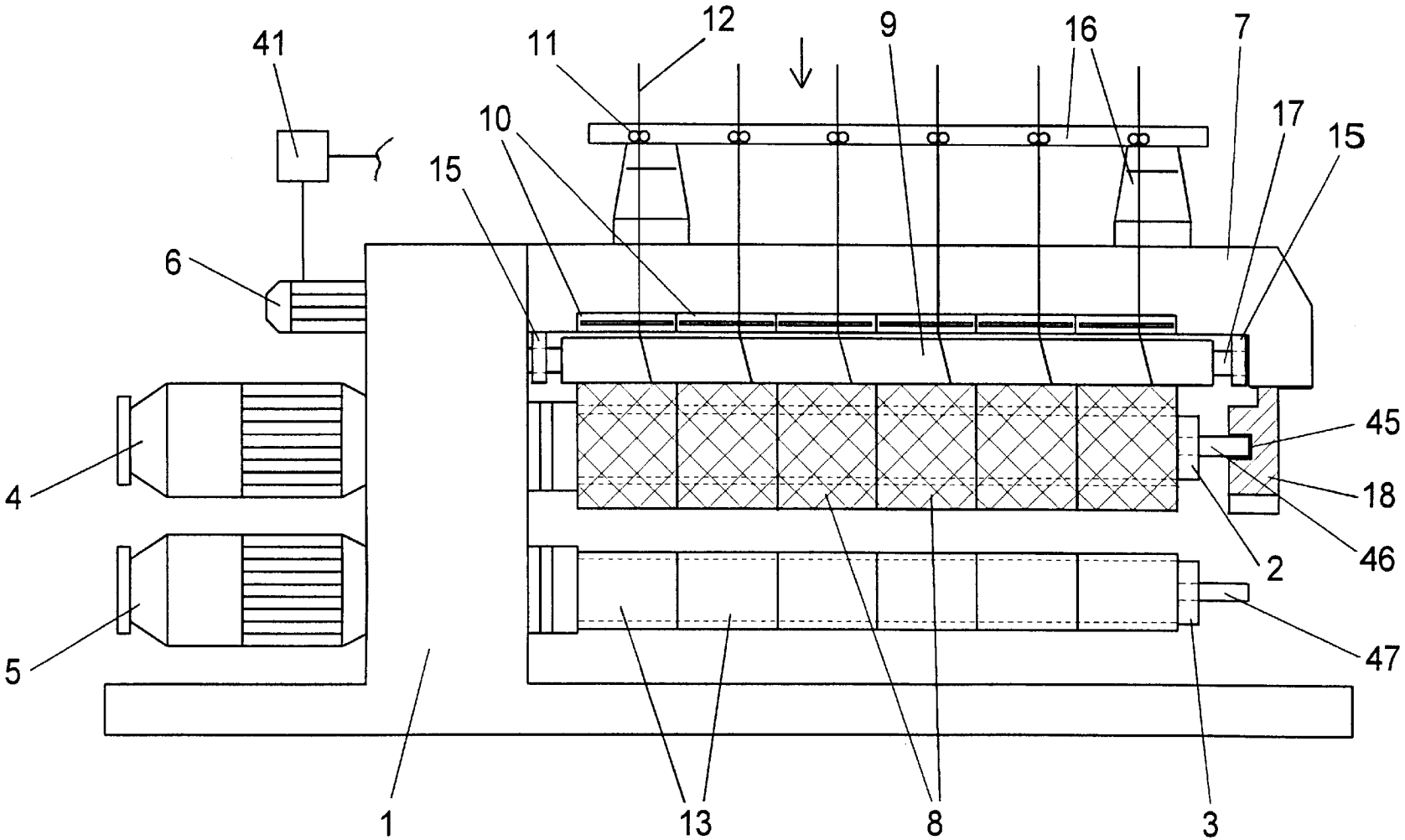
FIG. 6 is a schematic front view of a further embodiment of a takeup machine of the present invention.

FIGS. 6 and 7 show a schematic view of a further embodiment of the takeup machine in accordance with the invention. The following description applies to both Figures, unless otherwise specified.

The takeup machine of FIGS. 6 and 7 differs in its construction from that of the embodiment of the takeup machine shown in FIGS. 1 and 2 only in the design of the holding device. For this reason, the description of FIGS. 1 and 2 is herewith incorporated by reference and only the differences are described in the following.

At the free end of winding spindle 2, a holding device 18 is arranged in spaced relationship opposite to the end side of winding spindle 2. The holding device 18 is stationarily connected to beam 7. FIG. 6 is a cross sectional view of the holding device 18. The holding device 18 is constructed plate-shaped substantially crosswise to the winding spindle. The surface of the holding device 18 that faces the winding spindle contains as a first coupling element a groove 45. A second coupling element in the form of a mandrel 46 extends into the groove 45 in formfitting engagement therewith. The mandrel 46 is supported for rotation in the winding spindle 2 on the free end side thereof.

FIG. 7 is a front view of the holding device. The groove 45 extends over a partial range of a guide path 56 which is covered by winding spindle 2 or 3 as a result of the rotation of spindle support 27. The groove 45 has an extension congruent with the guide path 56. At the ends of groove 45, an inlet 48 and an outlet 49 are formed in the holding device. The inlet 48 and the outlet 49 are arranged one after the other in the direction of rotation of spindle support 27, so that the respective winding spindle with the empty tubes to be wound arrives at the winding position with its mandrel entering via the inlet into the groove 45. To this end, the free end of winding spindle 3 mounts likewise a mandrel 47 as an engagement means. The mandrel 47 can likewise enter into the groove 45 of holding device 18 by rotating the spindle support 27.

As shown in FIG. 7, the groove 45 in the holding device is shaped such that the mandrel 46 of winding spindle 2 remains engaged in the groove 45 of holding device 18 during the entire winding cycle. During the rotation of spindle support 27, the mandrel 46 will slide along in groove 45. In this embodiment, the free end of winding spindle 2 thus remains locked in position during the entire winding cycle. After the packages 8 are fully wound on winding spindle 2, the winding spindle 2 is rotated by the rotation of spindle support 27 from the winding range to a doffing range. In so doing, the mandrel 46 arranged on the free end of winding spindle 2 slides along groove 45 of the holding device, and finally disengages from holding device 18 via outlet 49. At the same time, the winding spindle 3 with empty tubes 13 is rotated into the winding range. Shortly before entering into the winding range, the mandrel 47 of winding spindle 3 enters via inlet 48 into the groove 45 of holding device 18. The mandrel 47 is guided in the groove 45 in formfitting engagement therewith. The yarn can now be transferred for winding new packages on winding spindle 3.

As shown in FIG. 7, the range of guide path 56 which is covered by holding device 18, and in which the free end of the winding spindle is secured in position, is shown by way of example. Depending on requirements, it is possible to vary the range in which the winding spindle is engaged with the holding device. Only for doffing the full package and mounting empty tubes will it be necessary that the holding device leave a section of guide path uncovered.

Figure 8:
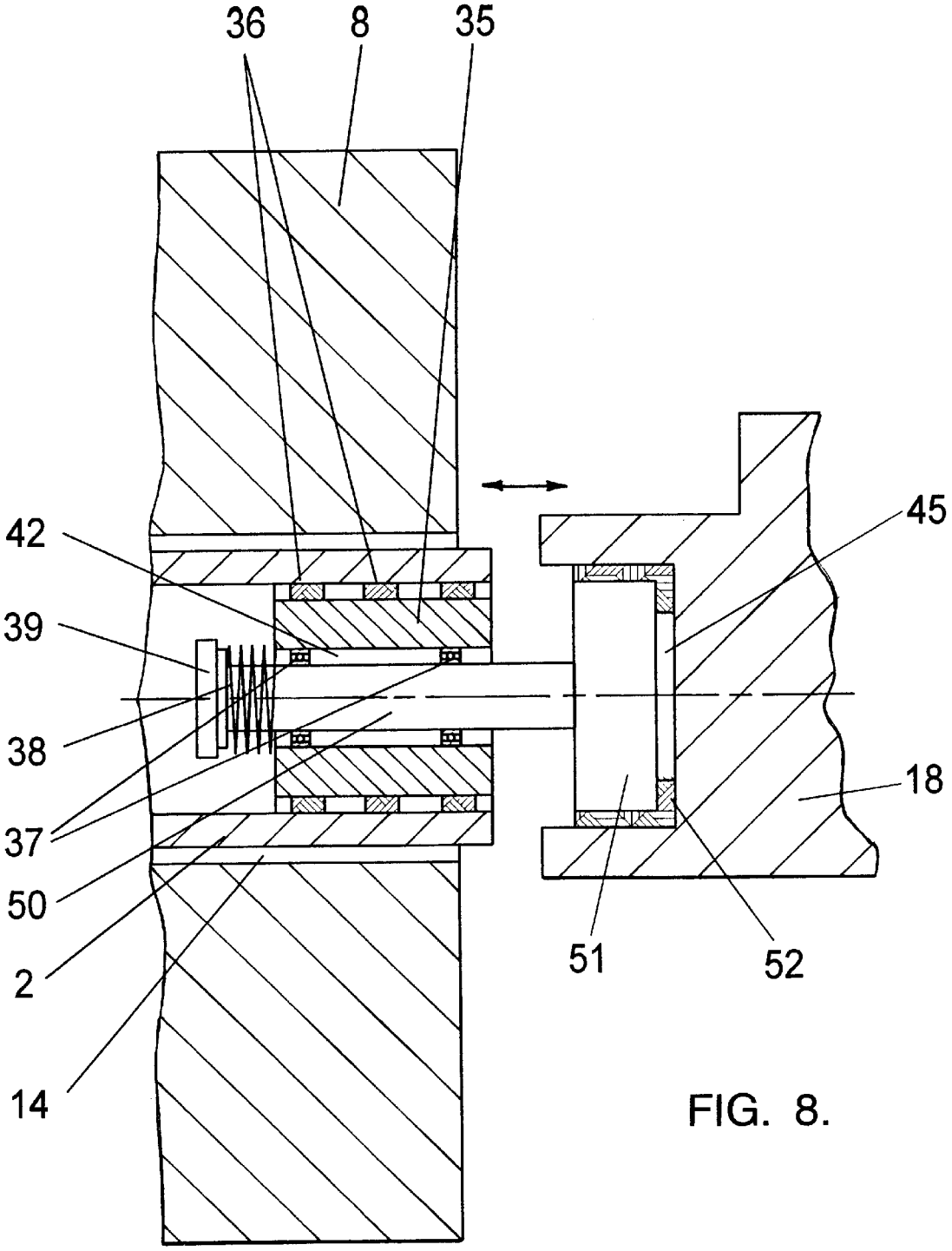
FIG. 8 is a schematic cross sectional view of a further embodiment of a holding device in engagement with the winding spindle.

FIG. 8 is a cross sectional view of a further embodiment of a holding device, as could be used in a takeup machine of FIG. 6. This Figure shows a cross sectional view of winding spindle 2 with its free end. Winding tubes 14 extend over the circumference of winding spindle 2. On the winding tubes 14, packages 8 are wound. To this end, the winding spindle 2 is driven for rotation. At its free end, the winding spindle 2 is provided with a cylindrical bore. At the end, in the casing of winding spindle 2, a sleeve 35 is nonrotatingly connected to the casing of winding spindle 2 by means of a plurality of elastic bearing elements 36. In its center, the sleeve 35 contains a bearing bore 42. In the bearing bore 42, a mandrel 50 is supported for rotation in bearings 37. One end of mandrel 50 projects from the end side of the winding spindle. At this end, an extension 51 is connected to the mandrel 50. At the opposite side, the mandrel 50 is provided with a cap 39. Likewise, this end of mandrel 50 extending in the interior of the winding spindle is located outside of sleeve 35. Between the cap 39 and sleeve 35, a compression spring 38 is arranged concentric with the circumference of mandrel 50. Thus, the compression spring 38 exerts a spring force on mandrel 50, which is directed in an axial direction toward the holding device 18. As a result, the extension 51 is held in groove 45 of the holding device 18 opposite to the end side of the winding spindle.

Between the walls of groove 45 and the extension 51 a slide element 52 is arranged. Preferably, the slide element is made elastic and slipped over the outer region of extension 51. The extension 51 is held via the slide element 52 in formfitting engagement with groove 45. The slide element 52 has the function of facilitating, first, a sliding of the mandrel substantially free of wear in the groove of the holding device. Furthermore, it realizes in addition a damping of vibration via the elastic formfitting engagement of the mandrel with the holding device. Furthermore, the elastic slide element permits compensation of errors in alignment between the winding spindle or the extension and the groove.

To be able to perform a package doff on the winding spindle by simply pushing the tubes off the winding spindle, the mandrel 50 with extension 51 is constructed with smaller outside dimensions than the outside diameter of the winding spindle.

Figure 9:
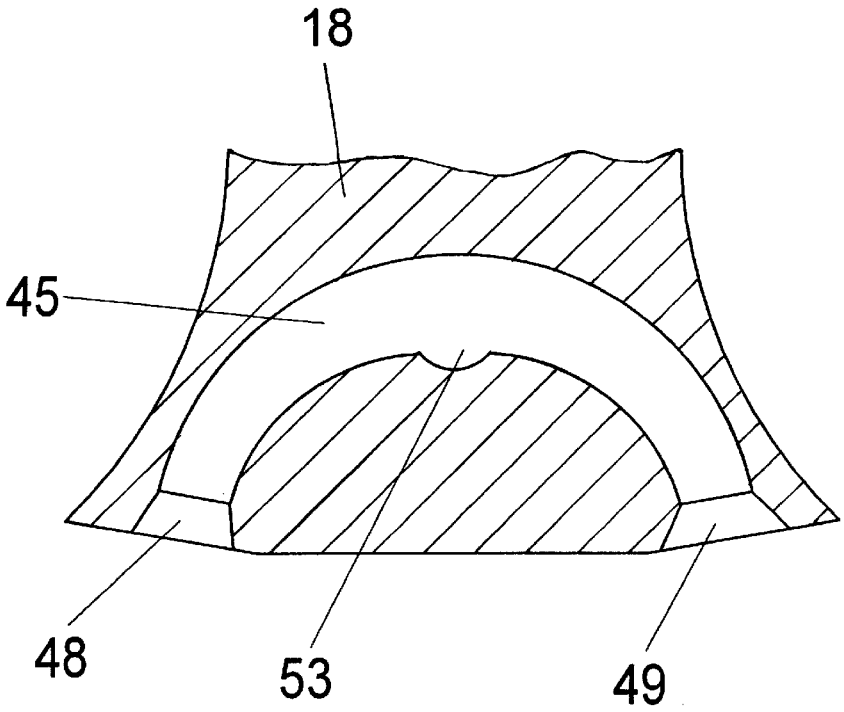
FIG. 9 is a schematic cross sectional view of a further embodiment of a holding device.

FIG. 9 shows a further embodiment of a holding device. In this embodiment, the holding device comprises a groove 45. The groove ends are provided respectively with an inlet 48 for engaging and an outlet 49 for disengaging a winding spindle. In the central region of the groove extension, the groove wall contains an indentation 53. This embodiment of holding device 18 can be used in particular in a takeup machine, wherein the winding spindle is stationarily held during the winding cycle. To this end, the deflection for winding the package is performed by the rocker arm 15 of contact roll 9 of the takeup machine shown in FIG. 7 or by a carriage, which mounts the contact roll and the yarn traversing device.

Figure 10:
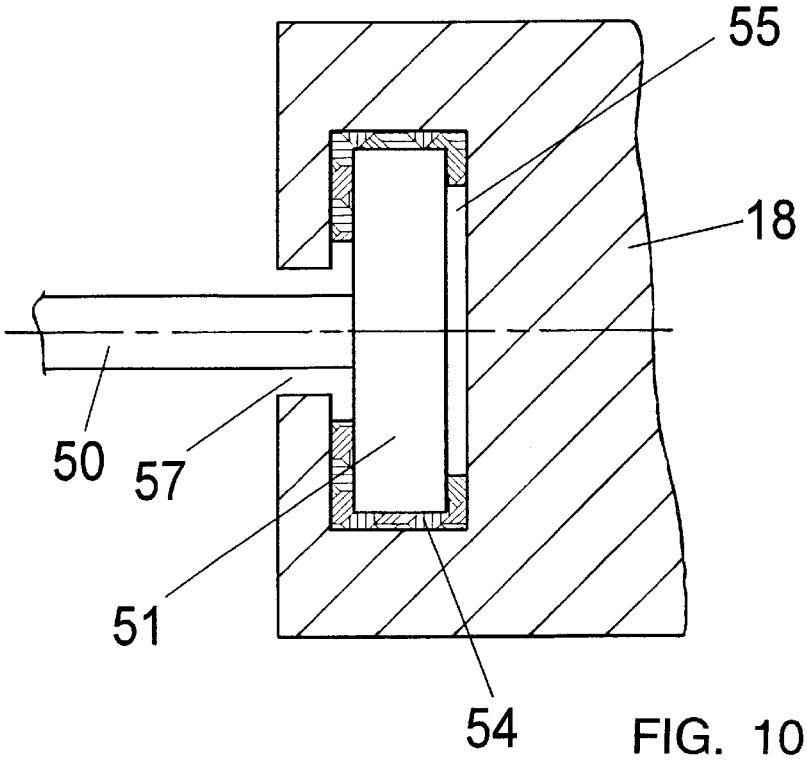
FIG. 10 is a schematic cross sectional view of a further embodiment of a holding device in engagement with the winding spindle.

FIG. 10 is a schematic, cross sectional view of a further embodiment of a holding device with a winding spindle engaged therein. To this end, holding device 18 contains a T-shaped groove 55. In this instance, the extension 51 extends in the wider portion of groove 55. Between the extension 51 and the walls of groove 55, a slide shoe 54 is arranged. Through groove opening 57, the mandrel 50 is connected to extension 51. Likewise, in this embodiment of a takeup machine, the holding device 18 is capable of absorbing with advantage in both directions forces that axially act upon the winding spindle. This embodiment is especially suited for applying very great holding forces.

That which is claimed:

1. An apparatus for winding at least one advancing yarn to form a yarn package, comprising a spindle support rotatably mounting at least one winding spindle in cantilever fashion so that the winding spindle defines a free end, with said winding spindle being sized to coaxially mount at least one bobbin tube, and with said spindle support being mounted to a machine frame for movement such that the winding spindle may be moved between a winding position and a package doffing position and such that the spindle support and the winding spindle can move relative to the machine frame while the winding spindle is at the winding position to accommodate the build of a package, drive means for selectively moving said spindle support to move the winding spindle while it is at said winding position to accommodate the build of a package and to move the winding spindle between said winding position and said doffing position, and a spindle holding device for supporting the free end of the winding spindle while it is positioned in said winding position, said spindle holding device comprising a first coupling element fixed to the machine frame and a second coupling element mounted at the free end of the winding spindle, with the first and second coupling elements being configured for interengagement when the winding spindle is in the winding position and for disengagement when the winding spindle is in the doffing position, and wherein said interengagement is maintained during relative movement of the first and second coupling elements caused by a movement of the winding spindle while the winding spindle is at said winding position.

2. The yarn winding apparatus as defined in claim 1 wherein one of said first and second coupling elements includes a magnet.

3. The yarn winding apparatus as defined in claim 1 wherein said first coupling element includes a magnet, and the second coupling element includes a magnetizable end plate mounted to the free end of the winding spindle for rotation about a central axis of the winding spindle, and such that the end plate comes under the action of the magnet when the spindle support moves the winding spindle to said winding position.

4. The yarn winding apparatus as defined in claim 3 wherein the magnet of the first coupling element is mounted to a holding device by means of an elastic damping element and wherein the holding device is fixed to the machine frame.

5. The yarn winding apparatus as defined in claim 3 wherein the magnet is a permanent magnet.

6. The yarn winding apparatus as defined in claim 3 wherein the magnet is an electromagnet, and further comprising a control for controlling the magnetic field strength of the electromagnet.

7. The yarn winding apparatus as defined in claim 3 wherein said magnet includes a front contact surface, and wherein said magnetizable end plate is mounted to a plunger, and wherein said plunger is mounted to the free end of the winding spindle for rotation about said central axis and for axial movement between a withdrawn idle position and an extended operating position.

8. The yarn winding apparatus as defined in claim 7 further comprising a spring for biasing the plunger and thus the magnetizable end plate toward said idle position, and wherein the magnet is adapted to move the end plate outwardly into contact with the front contact surface which defines said extended operating position.

9. The yarn winding apparatus as defined in claim 8 wherein the front contact surface is defined by a plate which extends over a range of movement covered by the winding spindle during the winding operation at said winding position.

10. The yarn winding apparatus as defined in claim 9 wherein said magnet comprises a plurality of separate magnets arranged along said range of movement.

11. The yarn winding apparatus as defined in claim 7 wherein the free end of the winding spindle includes a cylindrical bore, and wherein the plunger is mounted in the bore by means of a sleeve which coaxially mounts the plunger so as to permit rotational and axial movement of the plunger within the sleeve, and wherein the sleeve is coaxially mounted in said bore of said winding spindle by at least one elastic bearing element.

12. The yarn winding apparatus as defined in claim 1 wherein the first and second coupling elements comprise a male coupling element and a formfitting female coupling element.

13. The yarn winding apparatus as defined in claim 12 wherein the female coupling element comprises a groove formed in a holding device which is fixed to the machine frame, and the male coupling element comprises a mandrel at the free end of the winding spindle, and wherein the groove extends in a direction which follows the direction of movement of the winding spindle while the winding spindle is at the winding position, and wherein the mandrel is positioned to slide along said groove during such movement of the winding spindle.

14. The yarn winding apparatus as defined in claim 13 wherein the groove has an inlet for receiving the mandrel in the groove and an outlet where the mandrel is withdrawn from the groove.

15. The yarn winding apparatus as defined in claim 14 wherein the groove includes an indentation at a medial location along its length which receives the mandrel during the winding of the package.

16. The yarn winding apparatus as defined in claim 14 wherein the groove has a uniform cross section between the inlet and the outlet, and a length coextensive with the path of movement of the winding spindle during the winding of the package.

17. The yarn winding apparatus as defined in claim 14 wherein the mandrel includes an extension on its outer end which is configured so as to be received in the groove in a formfitting manner, and wherein the extension has a diameter which is not greater than that of the winding spindle.

18. The yarn winding apparatus as defined in claim 17 wherein the mandrel is mounted to the winding spindle by means of at least one elastic bearing element.

19. The yarn winding apparatus as defined in claim 17 wherein the free end of the winding spindle includes a cylindrical bore, and wherein the mandrel is mounted in the bore by means of a sleeve which coaxially mounts the mandrel so as to permit rotational and axial movement of the mandrel within the sleeve, and wherein the sleeve is coaxially mounted in said bore of said winding spindle by at least one elastic bearing element.

20. The yarn winding apparatus as defined in claim 17 further including an elastic slide member positioned between the mandrel and the groove when the mandrel is received in the groove.

21. The yarn winding apparatus as defined in claim 17 wherein the groove has a T or L-shape in cross section, and wherein the extension of the mandrel is configured so as to be received in the wider portion of the groove in cross section.

22. An apparatus for winding an advancing yarn onto bobbin tubes which are serially delivered to a winding position, comprising a spindle support rotatably mounting at least two winding spindles in cantilever fashion so that the winding spindles define respective free ends, and with each winding spindle being sized to coaxially mount at least one bobbin tube thereon, and with said spindle support being mounted to a machine frame for rotary movement such that each winding spindle may be moved between a winding position and a package doffing position, and such that the spindle support and each winding spindle can move while the winding spindle is at the winding position to accommodate the build of a package, a drive for rotating each of the winding spindles, rotary drive means for selectively rotating said spindle support to move each winding spindle while it is at said winding position to accommodate the build of a package and to move each winding spindle between said winding position and said doffing position, means for automatically transferring the advancing yarn from a rotating full package which has been moved from the winding position to the doffing position, to a rotating empty bobbin tube on a rotating winding spindle which has been moved to the winding position, and a spindle holding device for supporting the free end of each winding spindle while it is positioned in said winding position, said spindle holding device comprising a first coupling element fixed to the machine frame and a second coupling element mounted at the free end of each winding spindle, with the first coupling element being configured for interengagement with each second coupling element when the associated winding spindle is in the winding position, and for disengagement with each second coupling element when the associated winding spindle is in the doffing position, and wherein said interengagement is maintained during relative movement of the first and each second coupling element caused by a movement of the associated winding spindle while the associated winding spindle is at said winding position.

23. A method of winding an advancing yarn onto a bobbin tube which is coaxially mounted on a winding spindle to form a yarn package, comprising the steps of moving the winding spindle and the bobbin tube to a winding position while supporting the winding spindle in cantilever fashion so as to define a free end, then rotating the winding spindle about its axis, while traversing an advancing yarn at a location upstream of the winding position so as to define a winding operation during which a wound package is formed on the bobbin tube and during which the winding spindle at least periodically moves so as to accommodate the build of the package, and while supporting the free end of the winding spindle during the winding operation with a holding force, and then moving the winding spindle to a doffing position upon the package becoming full, and concurrently releasing the holding force.

24. The method as defined in claim 23 wherein the holding force is varied during the course of the winding operation.

25. The method as defined in claim 23 wherein the holding force is generated by an electromagnet with a controllable field strength.

26. The method as defined in claim 25 wherein during the winding operation the movement of the winding spindle is periodic, and wherein the field strength of the electromagnet is controlled so as to be greater when the spindle is stationary than when it is moving.

* * * * *